United States Patent [19]

Kruger

[11] 4,233,481

[45] Nov. 11, 1980

[54] MECHANICAL TRANSFER SWITCH

[76] Inventor: Jack L. Kruger, P.O. Box 215, Goffstown, N.H. 03045

[21] Appl. No.: 25,275

[22] Filed: Mar. 29, 1979

[51] Int. Cl.[2] ..... H01H 3/00

[52] U.S. Cl. ..... 200/153 D; 200/153 H; 200/325

[58] Field of Search ..... 200/153 R, 153 D, 153 H, 200/158 J, 156, 157, 325, 329, 335, 51 R, 51.02, 51.03, 51.04, 51.07, 51.11, 51.12

[56] References Cited

U.S. PATENT DOCUMENTS

| | | | |
|---|---|---|---|
| 1,551,304 | 8/1925 | Golladay | 200/325 |
| 1,834,550 | 12/1931 | Reed | 200/153 D |
| 2,770,702 | 11/1956 | Fjellstedt | 200/325 |
| 3,185,791 | 5/1965 | Cain | 200/153 H |

*Primary Examiner*—Willis Little
*Attorney, Agent, or Firm*—C. Yardley Chittick

[57] ABSTRACT

A mechanical transfer switch for use primarily in making rapid change of circuits in high energy coaxial transmission lines of the type employed in transmitting energy to a radio or television antenna. The switch is preferably manually actuated and includes structure in which a pivoted conductive bar is compelled to make simultaneous connection with or separation from the spaced terminals of the inner power conductors of a coaxial transmission line. The conductive bar includes two identical connectors which simultaneously engage two spaced terminals on the separated ends of the inner coaxial power line. The connectors on the conductive bar cannot be moved into connecting position with the two terminals until they are in exact axial alignment. In one form, the switch can connect a common terminal with anyone of a plurality of other terminals. In another form, the switch can be arranged to shift the connection between one pair of terminals to a connection between a second pair of terminals. In a third form, two connectors may be simultaneously employed to shift connections between a first common terminal and two alternative terminals and between a second common terminal and two alternative terminals.

14 Claims, 9 Drawing Figures

MECHANICAL TRANSFER SWITCH

BACKGROUND OF THE INVENTION

In the radio and television power transmission art, it is necessary or desirable from time to time to transfer the power source from a first antenna to a second antenna; to change from a first power source to a second power source to a single antenna; to disconnect the power source from the antenna and connect it to a load for testing purposes; (The Federal Communications Commission requires testing every six months to see if the station power output is between 110% and 80% of the licensed power of that station); to shift the connection between one power source and a first antenna to a connection between a second power source and a second antenna.

The foregoing situations are illustrative of conditions that require an easily and quickly operable safe switching mechanism. Heretofore, a switching unit called in the trade a Patch Panel has been in widespread use. Such units however are slow in operation as clamps must be removed, the connectors manually shifted and the clamps reapplied.

SUMMARY OF THE INVENTION

The present invention comprises a switching mechanism in which the movable and fixed electrically conducting elements are maintained in a box in insulated condition. An exterior manually operable handle is connected to the movable switching element in such manner that the element may first be disconnected from the terminals by pulling on the handle, the handle after complete disconnection may be rotated to bring the two connectors on the switching element into exact alignment with the new pair of terminals to be connected, the handle is then pushed toward the box, forcing the connectors on the element into positive engagement with their respective terminals. The aforesaid series of operations can be completed in as little time as two to three seconds without any special skill on the part of the operator and without any possibility of misalignment or improper contact of the connectors with the terminals.

The structure of the present invention precludes movement of the connecting element and the connectors mounted thereon toward the fixed terminals unless the parts are exactly aligned.

The connectors on the connecting element or conductive bar move in a straight line direction as they approach and engage simultaneously the terminals.

DESCRIPTION OF ONE EMBODIMENT OF THE INVENTION

Figure 1:
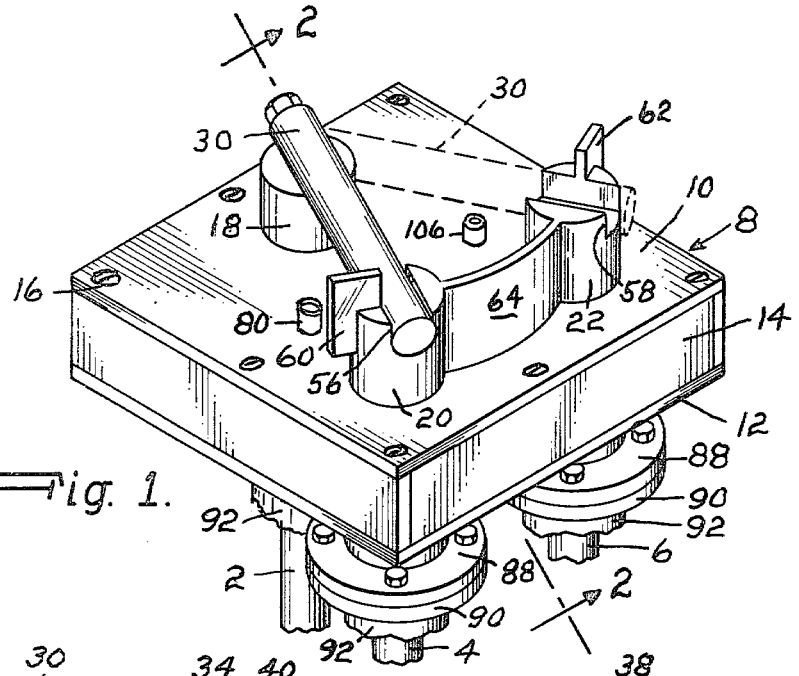
FIG. 1 is an exterior isometric perspective view of one form of the switch in which there is a common terminal and two other terminals with which selected connection can be made. The switch in this view is in closed position.

Referring first to FIG. 1, there is shown in isometric perspective a general view of the exterior appearance of the switch. This is known as a three port switch in which there is one coaxial line 2 which may be connected either to coaxial line 4 or coaxial line 6.

The switch generally comprises preferably a metal housing 8 having a removable top plate 10, a bottom plate 12 and connecting walls 14. It will be understood the housing may take any convenient form such as, for example, a single casting to which plate 10 may be removably secured by screws 16 to provide access to the interior.

Figure 2:
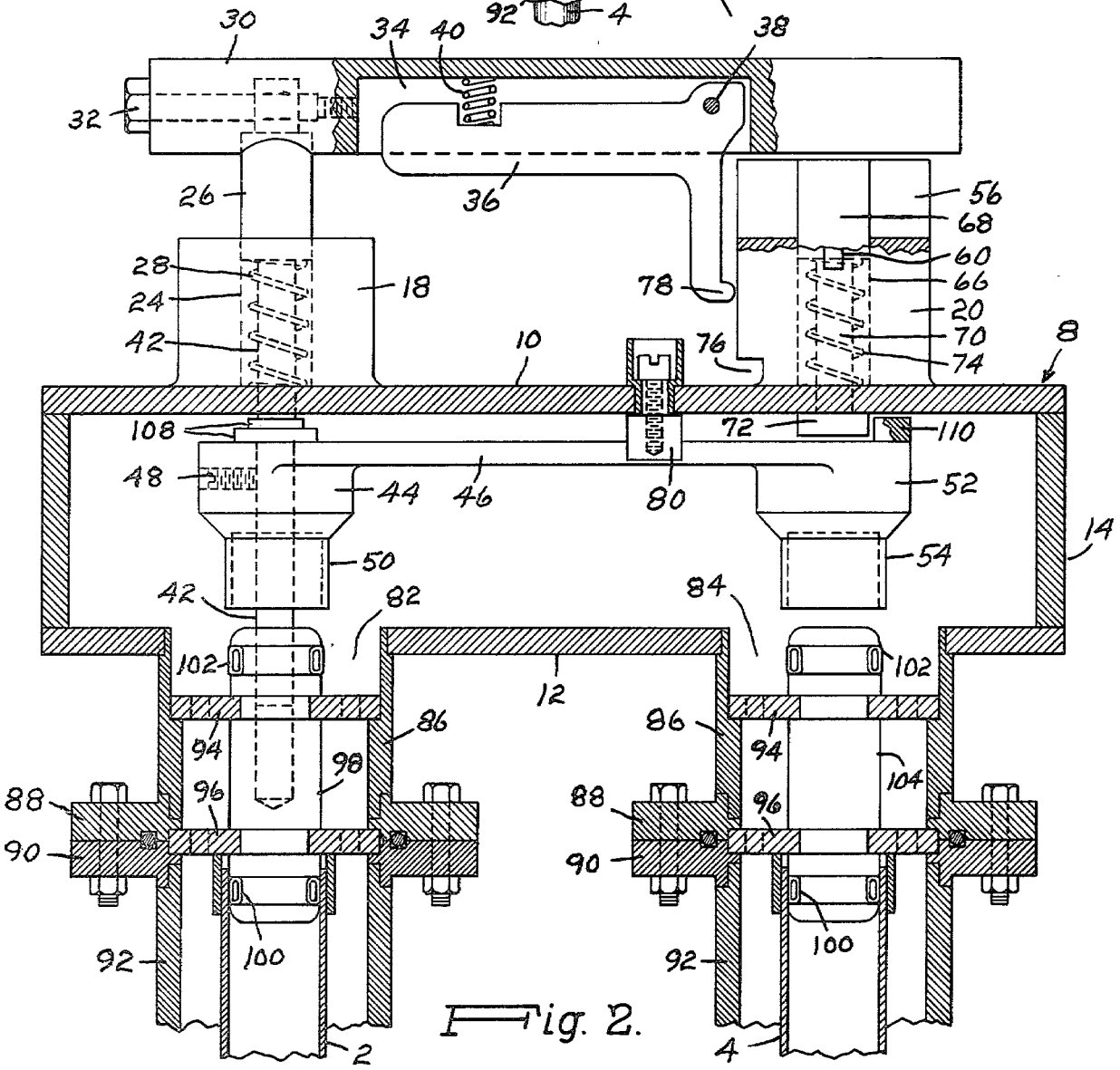
FIG. 2 is an enlarged cross sectional view taken substantially on line 2—2 of FIG. 1 with the switch in open position.
Figure 3:
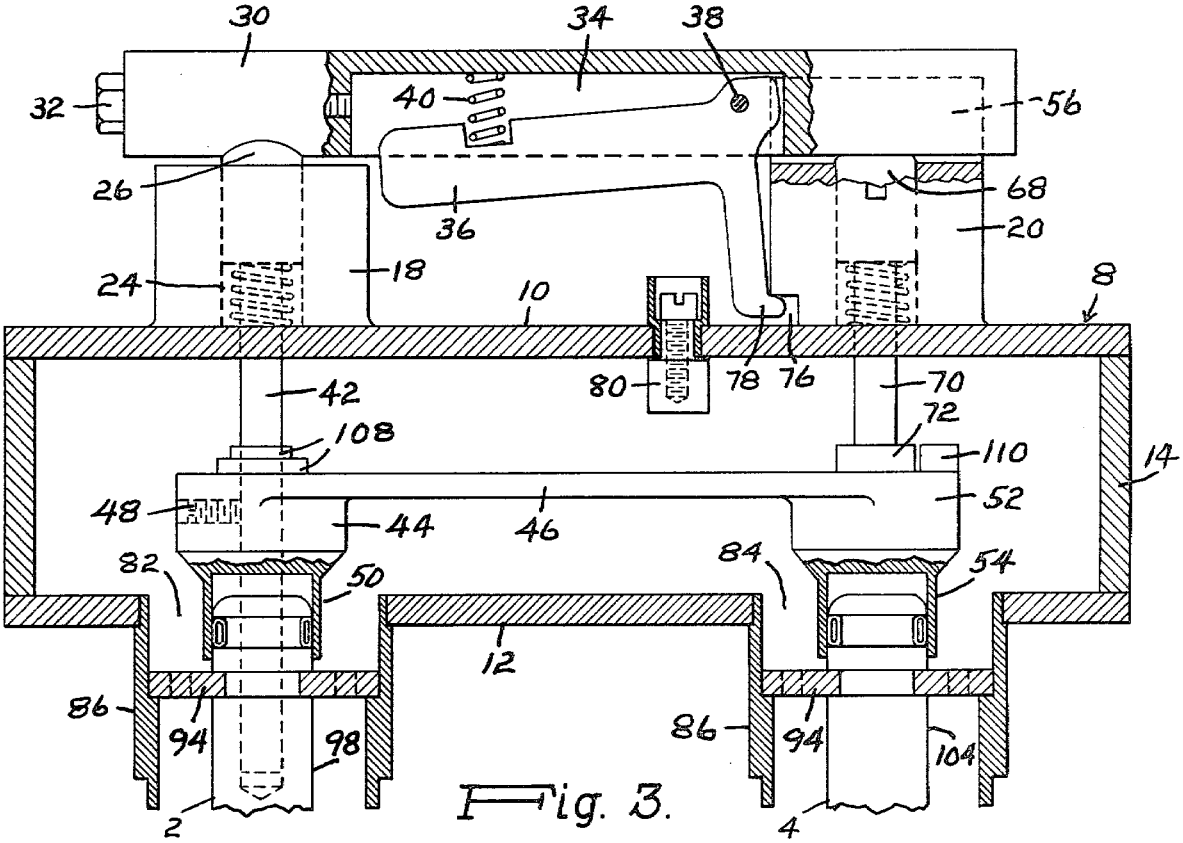
FIG. 3 is a view similar to FIG. 2 with the switch in closed position.

Referring now to FIGS. 1, 2 and 3, there are three short metal posts 18, 20 and 22 mounted on or integral with the top of plate 10.

Post 18 has a vertical cylindrical bore 24 therethrough in which is positioned in sliding relation a cylindrical shaft 26 supported by a compressible coil spring 28. The upper end of shaft 26 carries a horizontal handle 30 secured thereto by bolt 32 screwed into the center of the handle.

The handle 30 is longitudinally recessed along its underside at 34 to receive a latch lever 36 pivoted at 38 and urged downward by spring 40.

Extending vertically downward from shaft 26 is a long smaller diameter shaft 42. This shaft is fastened to and concentric with shaft 26, and passes through an aligned opening in plate 10. A hub 44 from which extends conductive bar 46 is mounted on shaft 42 and secured by set screw 48. Thus as shaft 42 is rotated by handle 30, so will bar 46 rotate in a horizontal plane within housing 8. On the bottom of hub 44 is a circular female connector 50. On the right hand end of bar 46 is another hub 52 and another female connector 54.

Again referring to FIGS. 1, 2 and 3 it will be noted that posts 20 and 22 are slotted as at 56 and 58 so that end of handle 30 can be received therein when the handle is aligned with the slot and moved downward. When handle 30 is in up position as shown in FIGS. 2, it clears the tops of post 20 and 22. Thus, in up position, handle 30 can be swung from a position over post 20 to a position over post 22. Swinging movement of handle 30 is limited by stops 60 and 62. Downward movement of handle 30 can only occur when the free end of the handle is directly above slot 56 or slot 58. Downward movement in any intermediate position is prevented by the wall 64 which extends from post 20 to post 22.

A central vertical bore 66 is provided in post 20. Mounted therein is a short plunger 68 which has a downward extension 70 that passes through plate 10 to terminate in an enlarged head 72. A compressible coil spring 74 holds the head 72 up against the underside of plate 10 and the top of plunger 68 is about flush with the top of post 20. Post 20 has a notch 76 close to plate 10 adapted to receive the hook end 78 of latch lever 36.

From the foregoing explanation, it is now apparent that when the handle is swung to a position against stop 60, it can then be pushed down a distance limited by engagement of the handle with the top of post 18 and with the bottom of slot 56 in post 20.

As the handle is manually pushed down against the force of springs 28 and 74, the conductive bar 46 will be correspondingly moved down by its attachment to shaft 42 at its left end and by the pressure of head 72 against its right end.

In addition to the stop 60 that limits clockwise movement of handle 30, there is also a stop 80 within the housing which simultaneously checks the clockwise movement of conductive bar 46.

The interior structure of post 22 is the same as that of post 20. Thus when handle 30 is swung counter-clockwise to engage stop 62, the handle may then be depressed in the same manner and to the same extent as when against stop 60.

Now that the movable parts of the switch have been described, the fixed parts with which the movable female connectors 50 and 54 cooperate will be explained.

Referring to FIGS. 2 and 3, the bottom plate 12 has three openings therethrough in which are mounted the terminal ends of the three coaxial lines 2, 4 and 6. Two of the openings are shown at 82 and 84. These are directly below posts 18 and 20. The third opening, not shown, is directly below post 22. The coaxial constructions at each opening are identical and a description of the structure at one opening will serve as the description of the structure at the other openings.

In FIG. 2, a short section of outer tubing 86 is fastened to plate 12. This has a flange 88 at its lower end to which is bolted flange 90 that carries the next section of outer tubing 92. Conventional insulators 94 and 96 support the end of the inner power tube 2 of the line. The terminal 98 fits within the end of tube 2 with good electrical contact supplied by watchband spring 100. The upper end of terminal 98 has a similar watchband spring 102 thereabout sized to fit snugly within connector 50.

The structure of terminal 104 on the end of power tube 4 is the same as that just described with respect to terminal 98 so the corresponding parts have been identically numbered. Thus, when the connectors 50 and 54 simultaneously descend as handle 30 is moved downward, they will make simultaneous engagement with the terminals 98 and 104 to close the circuit between lines 2 and 4.

The closed condition of the switch is shown in FIG. 3. The latch hook 78 automatically engages in notch 76 and the switch will stay in this closed condition without further attention.

Figure 4:
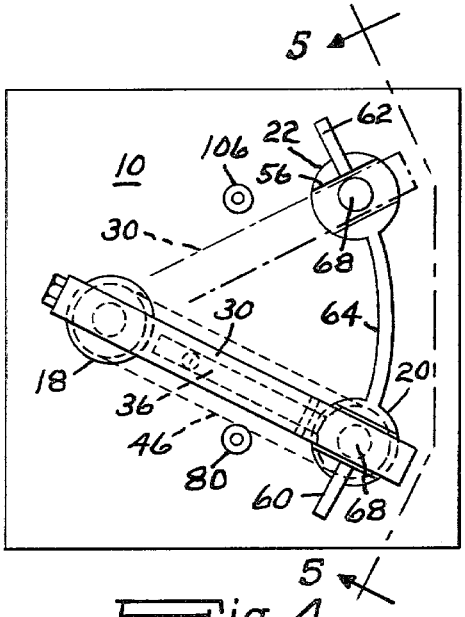
FIG. 4 is a plan view of FIG. 1.
Figure 5:
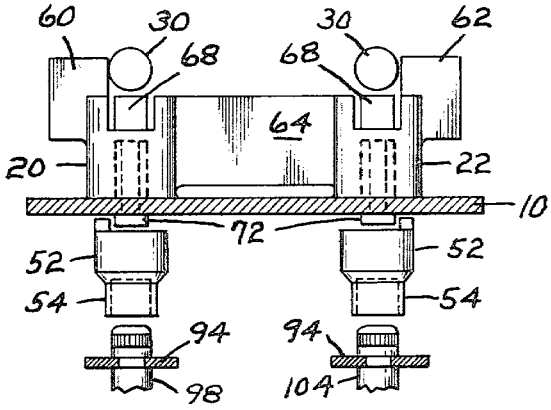
FIG. 5 is a fragmentary vertical elevation taken on the line 5—5 of FIG. 4 showing the handle in its two different positions.

When it becomes necesssary or desirable to disconnect line 2 from line 4 and connect line 2 with line 6, the following simple procedure is followed. The operator presses latch handle 36 upward freeing hook 78 from notch 76. The handle is then lifted causing connectors 50 and 54 to simultaneously separate from their respective terminals 98 and 104. When handle 30 reaches the limit of its upward travel, the free end of the handle will be above the top of post 20. The handle can then immediately be swung counter-clockwise until the handle engages stop 62 and conductive bar 46 engages an interior stop of which the exterior part is shown at 106 in FIGS. 1 and 4.

In this new location, the handle 30 may then be pushed down and the connector 50 will reengage terminal 98 and the connector 54 will engage the terminal unit (not shown) on the end of line 6. Thus in a matter of seconds the circuit from power line 2 is shifted from line 4 to line 6.

While nothing has been said so far about electrical insulation of the power carrying elements, it will be obvious to those skilled in this art that the following parts must be made of electrical insulating material: shaft 42, washers 108 on the upper side of hub 44, stops 80 and 106, shaft 70 and head 72, bumper 110 and tube supporting discs 94 and 96.

As is apparent, all of the parts may readily be made of adequate strength to withstand all operating forces without danger of breakage or short circuiting. While the drawings have shown the housing with the handle on top, it will be understood that the switch may be mounted in any convenient attitude, sideways on the wall or overhead with the handle down, without affecting its operation.

It will also be understood that while FIGS. 1 to 5 show a three port switch, the number of terminals with which line 2 is to be connected could be increased, limited only by the number that could be circularly arranged around line 2 while maintaining a constant radial distance from line 2.

Figure 6:
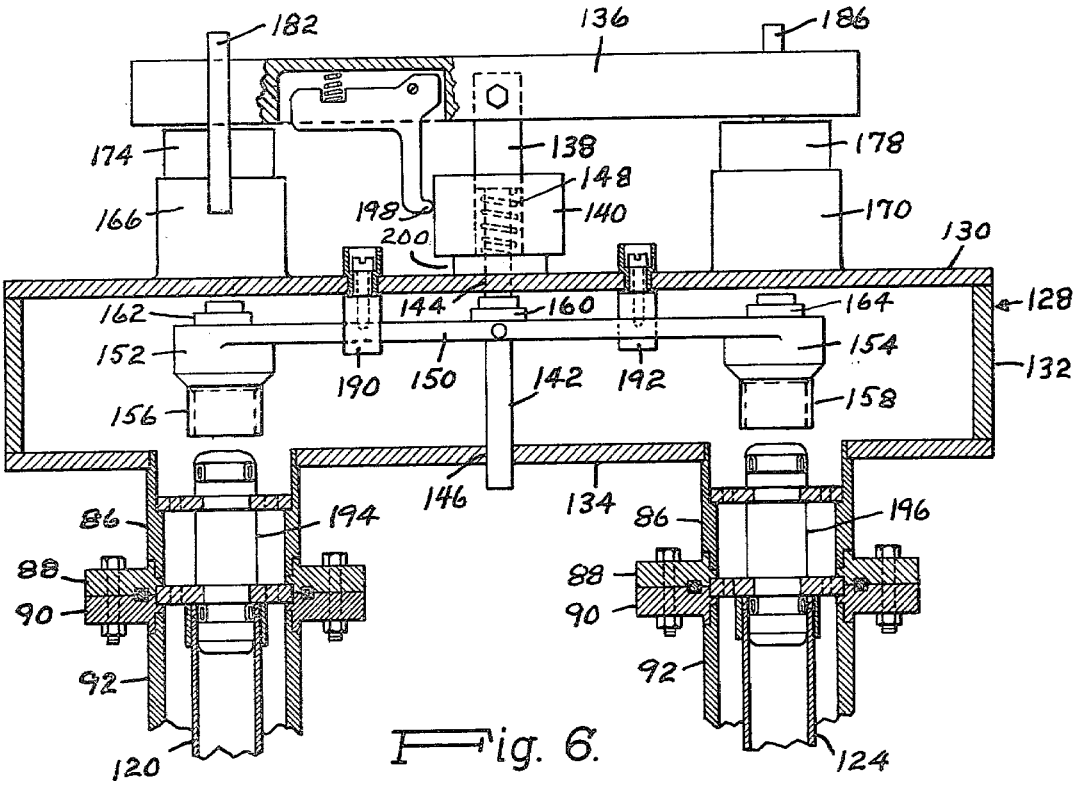
FIG. 6 is a vertical section of a modification taken on the line 6—6 of FIG. 7 with the switch open.
Figure 7:
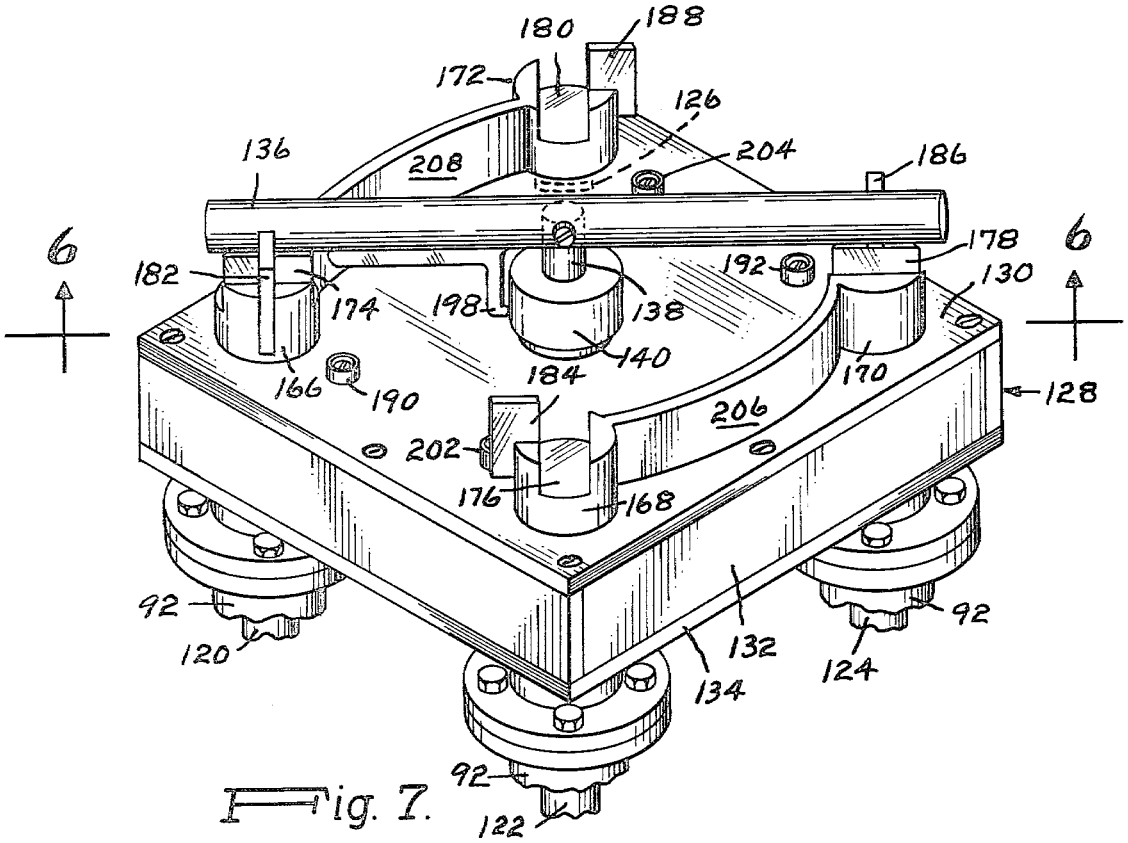
FIG. 7 is an isometric perspective of the modification shown in FIG. 6 in which there are two pairs of terminals which may be selectively connected.

The modification shown in FIGS. 6 and 7 operates on the same principles utilized in the construction shown in FIGS. 1 to 5. In FIGS. 1 to 5 there was one common line which could be connected to any one of a plurality of other lines. In FIGS. 6 and 7, there is no common line but rather a plurality of pair of lines of which any selected pair may be connected.

Thus, referring first to FIG. 7 which is an isometric perspective view of the modification, there are four coaxial lines 120, 122, 124 and 126. The switch is arranged to connect lines 120 and 124 or lines 122 and 126. The method of actuating the switch is the same as the method used with FIGS. 1 to 5. The handle is depressed and the desired circuit is closed and held closed by the latch. To change circuits, the latch is released, the handle raised, the handle rotated until other stops are engaged by the handle, and then the handle is again depressed to close the other circuit.

The principal structural difference is that the handle shaft supports the conductive bar at its mid point rather than at one end. Thus when the bar is depressed, equal downward force is automatically applied to the two female connectors as they are forced into engagement with their respective terminal units. This eliminates the need for a cooperating plunger such as plunger 70 (see FIGS. 2 and 3) to act against one end of the conductive bar to compensate for the force being applied directly down on the other end of the bar by the handle.

Turning now to FIGS. 6 and 7, the housing 128 has a removable top plate 130, side walls 132 and a bottom plate 134. A handle 136 is centrally mounted on a cylindrical shaft 138 movable vertically in a corresponding bore in post 140. A shaft 142 extends downward from shaft 138 through aligned holes 144 and 146 in top 130 and bottom 134. A coil spring 148 positioned about shaft 142 maintains the handle and related parts normally in up position.

The shaft 142 passes through the mid point of conductive bar 150 and is pinned thereto so that rotation of handle 136 will cause corresponding rotation of bar 150. At the ends of bar 150 are hubs 152 and 154 from which depend female connectors 156 and 158. Insulators 160 on shaft 142 and insulators 162 and 164 on top of the hubs limit upward movement of bar 150, shaft 142 and handle 136. Preferably for convenience in design, the handle 136 and bar 150 are parallel.

Four posts 166, 168, 170 and 172, not high enough to engage the handle when the handle is rotated in up position, are mounted on top plate 130. These posts are slotted as at 174, 176, 178 and 180 and have associated therewith stops 182, 184, 186 and 188. The stops are high enough to engage handle 136 to limit its rotation back and forth to positions in which the handle will be directly above the slots and the connectors on the conductive bar will be directly above their respective terminals.

When the handle 136 is in the position shown in FIGS. 6 and 7, it will be in engagement with stops 182 and 186 and directly above slots 174 and 178. The bar 150 will have engaged the interior stops 190 and 192 and the connectors 156 and 158 will be directly above terminals 194 and 196. Under these conditions handle 136 can be depressed so that the circuit is closed between lines 120 and 124. The latch 198 automatically engages in notch 200 to hold the switch closed.

When it is desired to connect line 122 and 126, latch 198 is released, handle 136 raised disconnecting lines 120 and 124, the handle is rotated clockwise until stops 184 and 188 are engaged and at the same time bar 150 will have engaged the interior stops 202 and 204. The connectors 156 and 158 will then be located above and in alignment with the respective terminals on lines 122 and 126. The handle can then be depressed to complete the circuit between these lines.

The walls 206 and 208 prevent any accidental depressing of handle 136 as it is being shifted between proper switch closing positions.

The above described switching operation can be performed in a matter of 2 to 3 seconds.

It will be obvious to those familiar with electrical switches that the power lines 120, 122, 124 and 126 and the conductive bar 150 must be insulated from the rest of the structure. Thus the following elements at least should be of insulating material; shaft 142, stops 160, 162 and 164, stops 190, 192, 202 and 204 and the discs that support the coaxial power lines within the outer tubes.

Figure 8A:
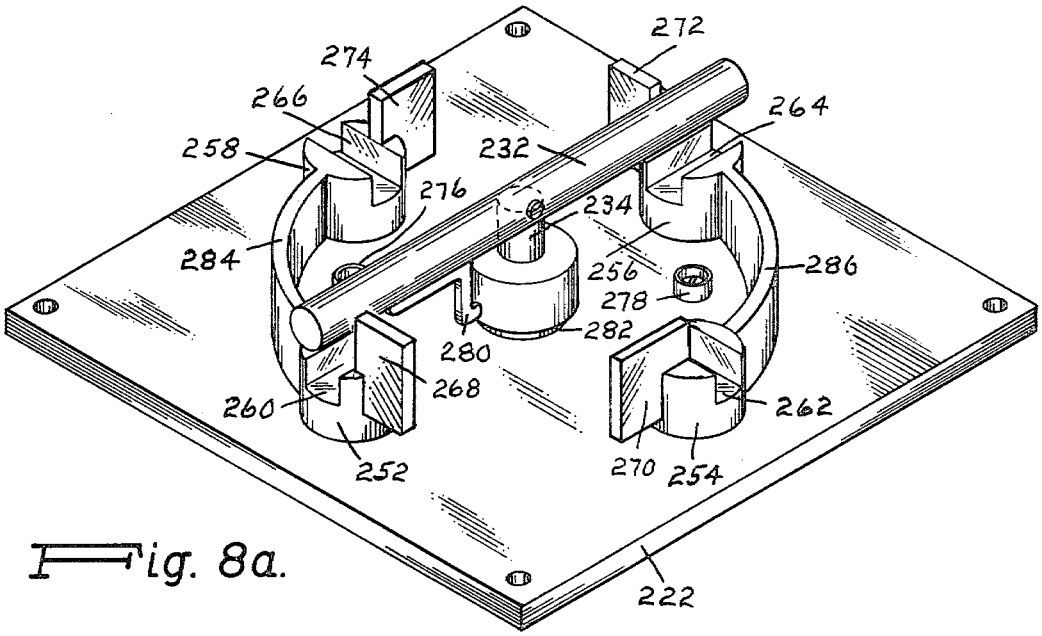
FIGS. 8*a* and 8*b* are an exploded view of another modification in which the connections with two common terminals may be shifted to two selected alternative terminals.
Figure 8B:
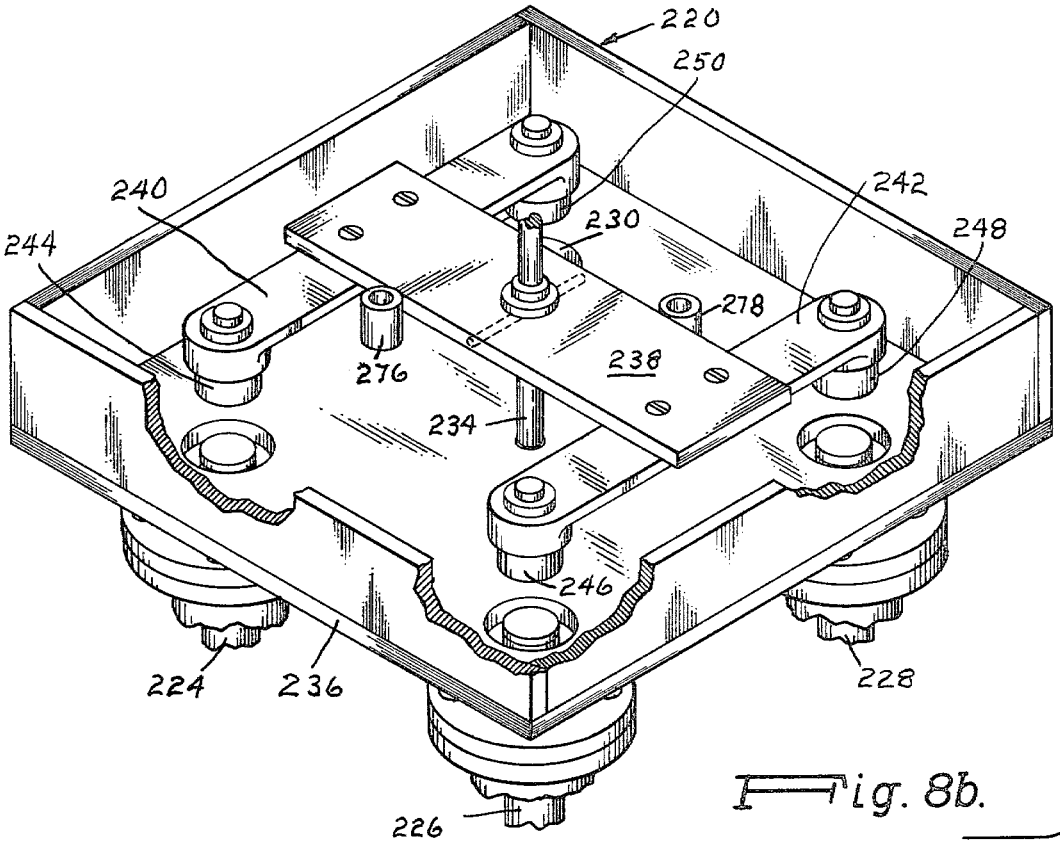

Another modification is shown in FIGS. 8*a* and 8*b*. Exactly the same principles of operation are employed as those explained in relation to FIGS. 1 to 7. The difference resides in the circuits that may be simultaneously connected and disconnected.

In FIG. 8*b*, the switch mechanism is shown as contained in a metal housing 220 with the separated cover 222 apearing in FIG. 8*a*. The four coaxial power lines 224, 226, 228 and 230 are the same as lines 120, 122, 124 and 126 shown in FIGS. 6 and 7.

The objective in this case is to be able to connect line 226 with lines 228 or 224 while at the same time connecting line 230 with lines 224 or 228.

The construction for accomplishing this is as follows. A handle 232 is mounted on shaft 234 which extends through cover 222 and bottom 236. A connector supporting member of insulating material 238 is pinned to shaft 234.

Member 238 has affixed to its ends conducting bars 240 and 242 which carry at their ends female connectors 244, 246, 248 and 250.

The structure on the top of cover 222 is substantially the same as that shown in FIG. 7. There are four posts 252, 254, 256 and 258 slotted respectively at 260, 262, 264 and 266 to receive the ends of handle 232 when it is moved downwardly.

Stops 268, 270, 272 and 274 limit rotation of handle 232 and member 238 to 90°.

Additional stops 276 and 278 depend from cover 222 positioned to engage member 238 to limit rotation of member 238 to positions where the female connectors will be in exact alignment with the male connectors on the upper ends of the power lines.

The handle 232 is arranged to be parallel to conductors 240 and 242 so that the user may be informed of the position of the switching elements by noting the position of the handle.

The latch 280 cooperates with the notch 282 to hold the mechanism in down engaged position.

The walls 284 and 286 preclude downward movement of handle 232 and the conductors 240 and 242 when the handle is being rotated from one switching position to the other.

From the construction just described, it will be apparent that when the handle 232 is in the position shown in FIG. 8*a*, it may be depressed to close the circuits between lines 226 and 228 and between lines 224 and 230. When the handle is rotated 90° clockwise to engage stops 270 and 274 in which position it will be over slots 262 and 266, it may be depressed to close the circuits between lines 226 and 224 and between lines 230 and 228.

In the preferred construction, all of the male connectors of the power lines 224, 226, 228 and 230 include watchband springs thereabout such as springs 102 shown in FIGS. 2, 3, 5 and 6.

The foregoing description of the invention will suggest to others skilled in the art modifications which will be within the scope of the invention as defined by the appended claims.

I claim:

1. A switch for use in R F transmission, said switch comprising a first supporting plate, a shaft extending through said first plate and mounted thereon for rotative and axial movement, a handle fixed to said shaft on one side of said plate, a rigid conductive bar associated with said shaft on the other side of said plate whereby movement of said handle will cause corresponding movement of said bar, spaced electrical connectors on said bar, a second supporting plate fixedly spaced from said first plate, a plurality of cooperating electrical terminals mounted on said second plate and electrically insulated therefrom, said cooperating terminals located on said second plate to receive said bar connectors when said connectors are first aligned with said terminals by suitable rotation of said handle and said connectors are than caused to engage said terminals by movement of said handle toward said first plate, whereby the circuit between a selected pair of terminals can be closed and means for preventing movement of said bar and connectors toward said second plate except when the bar connectors are aligned with two of said cooperating terminals.

2. The switch set forth in claim 1, and means for applying substantially equal force to said bar connectors in the direction of said second plate when they are being placed in engagement wiht said cooperating terminals.

3. The switch set forth in claim 1, one of said bar connectors and one of said cooperating terminals being circular and located coaxially with said shaft whereby the terminal aligned with said shaft can be selectively connected by said bar to any other of said cooperating terminals.

4. The switch set forth in claim 3, said shaft extending into said coaxial cooperating terminal.

5. The switch set forth in claim 1, all said bar connectors and cooperating terminals being circular and of male and female type, each male connector including a watchband spring thereabout to improve the electrical contact with its said female connector.

6. The switch set forth in claim 1, and manually releasable mechanical means for holding said switch in closed position.

7. The switch set forth in claim 1, and stops for limiting the rotating movement of said bar at positions where the bar connectors and cooperating terminals are aligned.

8. The switch set forth in claim 3, and means actuated by said handle for causing the application of substantially equal force to both bar connectors as they are moved into engagement with said cooperating terminals.

9. The switch set forth in claim 8, the said means actuated by said handle comprising a movable member permanently mounted on and extending through said first plate in alignment with one of said cooperating terminals on said second plate, one end of said movable member adapted to be engaged and moved by said handle when said handle is moved toward said first plate to cause the other end of said movable member to engage the said bar behind one of said bar connectors, whereby substantially equal forces will be applied by said handle to the ends of said bar to cause engagement of said bar connectors with said aligned cooperating terminals.

10. The switch set forth in claim 1, the cooperating terminals that are adapted to be engaged selectively by one of the said bar connectors being arranged along a first circular path, the cooperating terminals that are adapted to be engaged by the other of said bar connectors being arranged along a second circular path, the axis of said shaft on which is mounted said bar being located within the said first and second circular paths, the distance of said one bar connector from said shaft being equal to the radius of said first circular path and the distance of said other bar connector from said shaft being equal to the radius of said second circular path.

11. The switch set forth in claim 10, the radii of said first and second circular paths being equal.

12. The switch set forth in claim 10, the cooperating terminals being limited to two pairs, the radii of said first and second circular paths being equal, stop means for limiting rotation of said bar clockwise at a position where the two bar connectors are located in alignment with one pair of cooperating terminals and other stop means for limiting rotation of said bar counter-clockwise at a position where the two bar connectors are located in alignment with another pair of cooperating terminals.

13. The switch set forth in claim 1, said rigid conductive bar being connected to said shaft by a supporting member of insulating material, a second rigid conductor bar affixed to said member, two connectors on each said bar, means for limiting rotation of said handle through 90° whereby when said handle is at the limit of its movement and is moved toward said first plate said connectors will be connected alternatively to a common terminal and either of two other terminals.

14. A switch for use in R F transmission, said switch comprising first and second spaced supporting plates, a shaft extending through said plates and mounted for rotative and axial movement, a handle fixed to said shaft on the exterior side of said first plate, a supporting member fixed to said shaft between and parallel to said plates, first and second rigid conductor bars mounted in parallelism on the ends of said supporting member, two spaced electrical connectors on each said bar, all said connectors being equidistant from the axis of said shaft and equidistant from each other, four cooperating electrical terminals mounted on said second plate and electrically insulated therefrom, said cooperating terminals spaced to receive said connectors when the latter are aligned therewith and said handle is moved toward said first plate, stop means on said first plate for limiting rotation of said handle to 90°, said stop means so located that when said handle is in either limited position, said connectors will be aligned with said four terminals, and means for preventing movement of said handle toward said first plate except when said connectors and said terminals are aligned.

* * * * *